United States Patent [19]

Scanferla

[11] Patent Number: 4,917,077

[45] Date of Patent: Apr. 17, 1990

[54] WALL-MOUNTED HOT WATER BOILER OF THE INSTANT TYPE

[76] Inventor: Giorgio Scanferla, Via O. Marinali, 52, 36061 Bassano del Grappa - Vicenza, Italy

[21] Appl. No.: 178,921

[22] Filed: Apr. 7, 1988

[51] Int. Cl.[4] ..... F24H 1/08

[52] U.S. Cl. ..... 126/344; 219/306; 219/308

[58] Field of Search ..... 62/263; 126/344, 350 A; 296/24 A, 296; 138/116; 219/306, 308

[56] References Cited

U.S. PATENT DOCUMENTS

| | | | |
|---|---|---|---|
| 1,802,316 | 4/1931 | Bree | 219/324 |
| 2,553,212 | 5/1951 | Rouis et al. | 219/321 |
| 4,324,028 | 4/1982 | Severson | 29/157.3 C |
| 4,567,350 | 1/1986 | Todd, Jr. | 219/298 |

FOREIGN PATENT DOCUMENTS

| | | | |
|---|---|---|---|
| 0000584 | 2/1979 | European Pat. Off. . | |
| 169780 | 3/1982 | Netherlands | 126/350 A |

OTHER PUBLICATIONS

Caldaie Beretta brochure entitled "Caldaia Paros Solare" (Jan. 1986); no translation.

*Primary Examiner*—Alan Cohan
*Assistant Examiner*—Allen J. Flanigan
*Attorney, Agent, or Firm*—Fitzpatrick Cella Harper & Scinto

[57] ABSTRACT

A wall-mounted hot water boiler of the instant type comprises a plurality of plumbing components in fluid communication with one another by plumbing lines preformed on a wall member, which wall member forms a hanging frame for the wall-mounted boiler; the plumbing lines are defined between two juxtaposed metal sheets and provided with fittings for connecting and supporting mechanically respective ones of the plumbing components.

6 Claims, 4 Drawing Sheets

WALL-MOUNTED HOT WATER BOILER OF THE INSTANT TYPE

DESCRIPTION

This invention relates to a wall-mounted hot water boiler of the instant type comprising a plurality of water system components in mutual fluid communication through piping lines.

In the field of instant wall-mounted boilers adapted to generate hot water for heating and sanitary purposes, a major requisite is for such boilers to be kept compact in overall size; in fact, they are expediently installed mostly in kitchens, and owing to the popularity enjoyed by sectional cabinet kitchens of modular design, their dimensions should not exceed those of standard hanging cabinets.

Accordingly, the several plumbing components of a wall-mounted hot water boiler, such as the pump, heat exchangers, three-way valve, degassing valve, and expansion tank—which are all carried on the hanging frame of the boiler—are positioned at the most suitable locations both in consideration of the aforesaid requirement and for operational reasons.

After the various plumbing components have been laid out on the hanging frame, they are interconnected by means of a complex piping system wherein the individual pipes frequently follow twisted paths and are usually formed from copper tubing by virtue of this material being easily shaped and bent.

These conventional type wall-mounted hot water boilers are disadvantageous on account of the cost of their copper plumbing as well as of their assembly and maintenance procedure requirements. In fact, owing to the boiler being accessible only from the front, after removing its face panel an assembly priority order must be observed in the plumbing connections of the various components which is not always an ideal one, being as a matter of fact conditioned by the component accessibility.

Further, as relates to servicing, it is often necessary, in order to get at a pipe or replace some of the components, to remove other parts, which increases service time and cost.

The problem underlying this invention is to provide a wall-mounted hot water boiler of the type specified above, which has such constructional and operational features as to obviate the aforementioned drawbacks affecting the prior art.

This problem is solved according to the invention by a boiler as specified above being characterized in that it comprises a wall member whereon at least some of the plumbing lines are preformed.

Advantageously in a preferred embodiment of the invention, said wall member comprises first and second juxtaposed metal sheets wherebetween said plumbing lines are defined.

Further features and the advantages of a hot water boiler according to the invention will become apparent from the following description of a preferred embodiment thereof, given by way of illustration and not of limitation with reference to the accompanying drawings.

Figure 1:
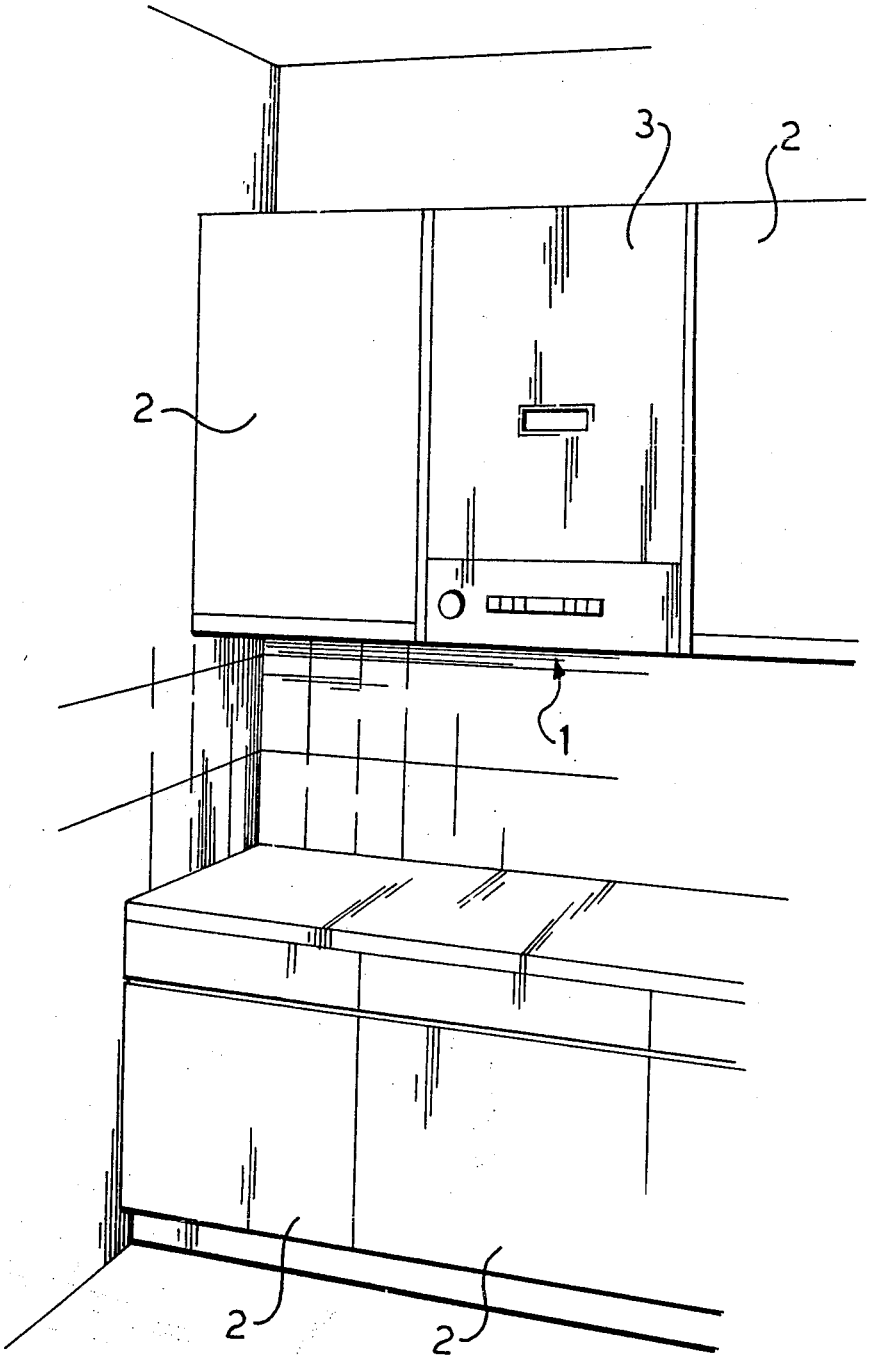
FIG. 1 is a perspective view showing diagrammatically a wall-mounted hot water boiler according to the invention as installed between hanging cabinets of a kitchen suite, known per se and being only partially depicted.

With reference to the drawing figures, the numeral 1 generally designates a wall-mounted hot water boiler of the instant type, according to this invention, which is adapted to deliver hot water for heating and sanitary uses. The wall-mounted hot water boiler 1 is, moreover, designed to fit between hanging cabinets 2 of standard size in a conventional modular sectional cabinet kitchen.

The wall-mounted boiler 1 comprises a face panel 3, known per se, and sidewalls, not shown, which are adapted for attachment to a hanging frame 4 oppositely located from the face panel 3 and to be further described hereinafter.

The face panel 3, sidewalls, and hanging frame 4 make up a container of substantially parallelepipedal shape wherein a plurality of conventional plumbing components comprehensively designated 5 are supported. In particular, shown diagrammatically in the drawing figures as the plumbing components 5 are a primary heat exchanger 6, a secondary heat exchanger 7, a circulation pump 8, a three-way valve 9, an expansion tank 10, and an air vent valve 11.

The aforesaid plumbing components 5 are in fluid communication with one another through plumbing lines comprehensively designated 12.

In accordance with this invention, the lines 12 are preformed on a wall member of the boiler 1, and this wall is suitably arranged to coincide with the hanging frame, being denoted by the same reference numeral 4.

Figure 5:
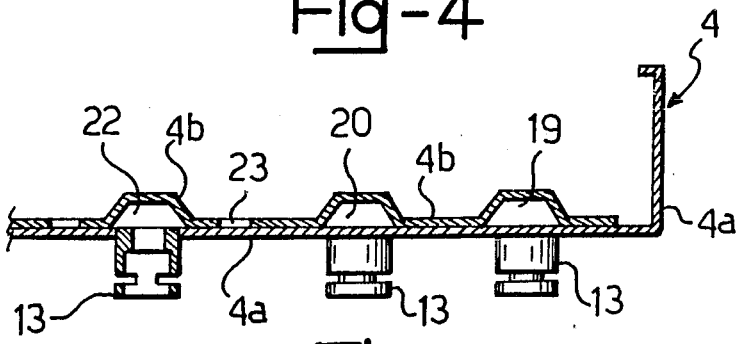
FIG. 5 is an enlarged scale view of a detail of the boiler according to this invention, as taken along the section line V—V in FIG. 4.

Referring to FIG. 5, the wall 4 includes first and second metal sheets **4*a* and 4*b* , respectively, in juxtaposed relationship, and the plumbing lines 12 are formed preferably by a molding process on one, say 4*b***, of said metal sheets, or alternatively, on both sheets (not shown).

Said lines 12 are then sealed by such conventional joining operations as roll welding or cementing.

Figure 3:
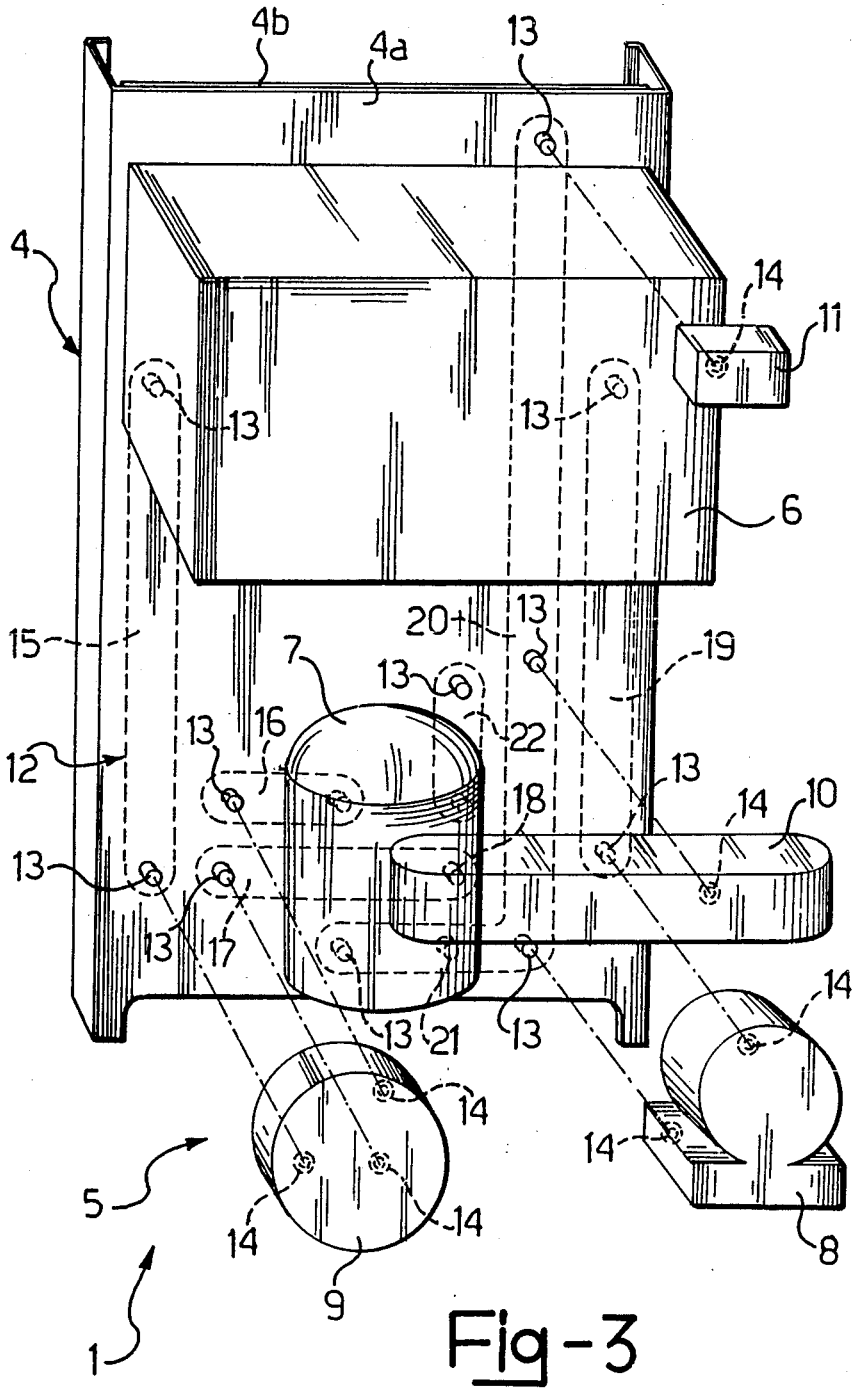
FIG. 3 is a perspective view of the boiler of FIG. 2, with some parts shown in exploded view.

The lines 12 formed on the wall or hanging frame 4 are provided with fittings 13 fastened to the first metal sheet **4*a* for connection to respective ones of the plumbing components 5, which are in turn formed with pipe connections 14 (see FIG. 3) adapted to fit tightly in the fittings 13**.

Advantageously, the fittings 13 also provide mechanical support for the plumbing components 5 on the wall 4.

Figure 2:
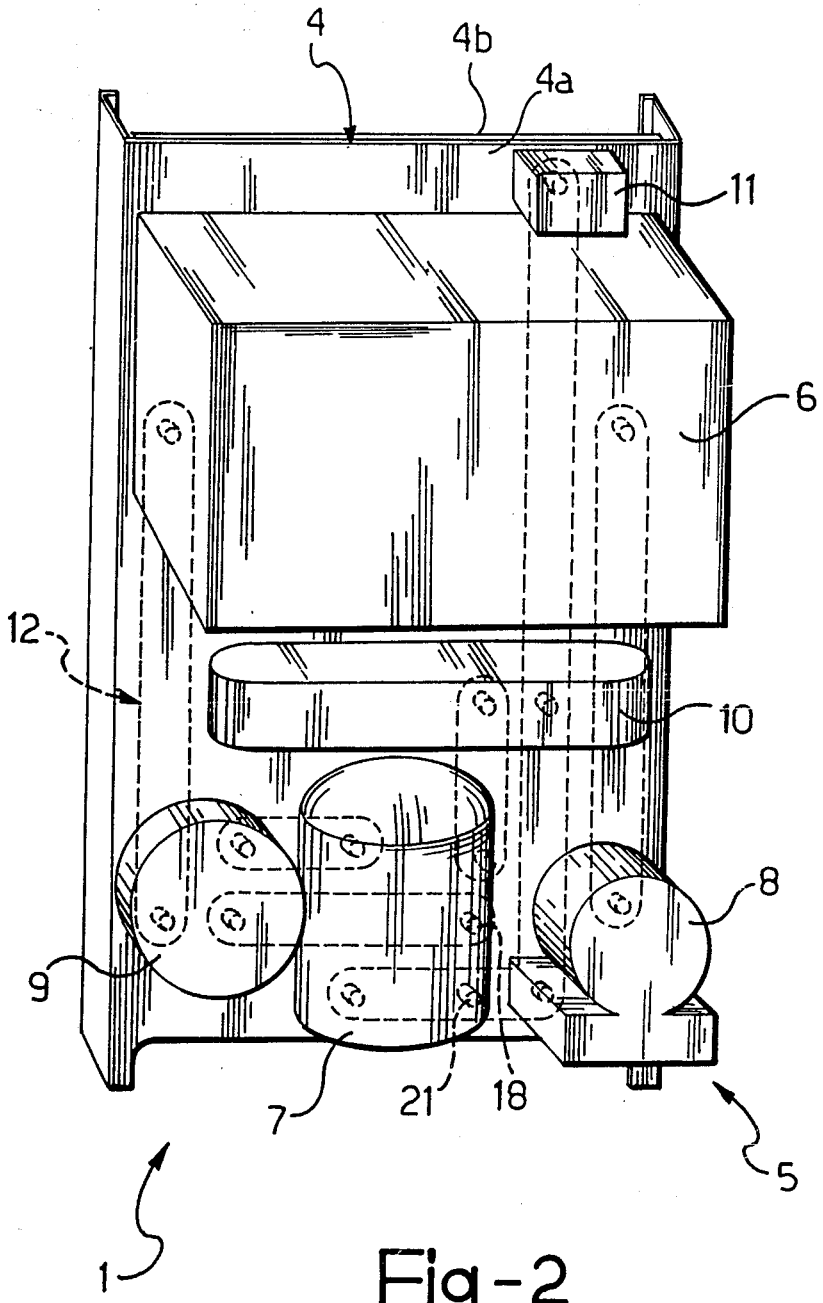
FIG. 2 is a perspective view showing in diagrammatic form the boiler of FIG. 1, with its face panel and sidewalls removed.
Figure 4:
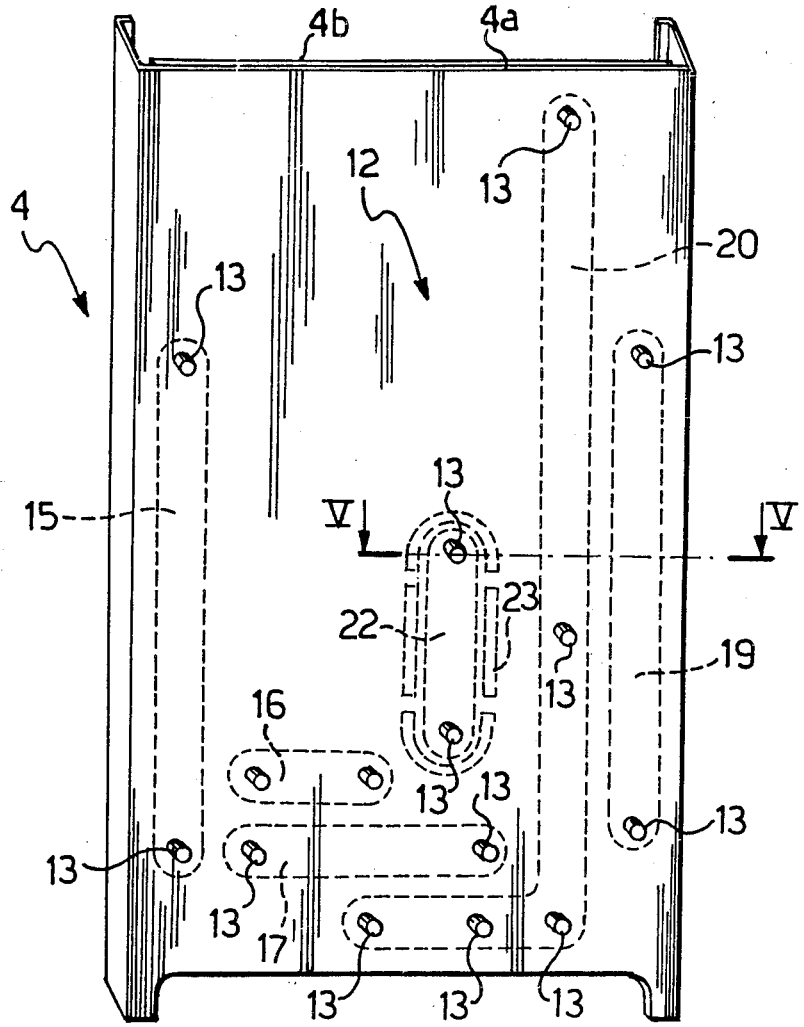
FIG. 4 is a perspective view of a detail of FIG. 2.

In the exemplary wall-mounted hot water boiler 1 of the instant type shown in FIG. 4 of the drawings, the plumbing lines 12 formed on the wall 4 include a first line 15 for connecting the primary heat exchanger 6 to the three-way valve 9, a second line 16 for connecting the valve 9 to the secondary heat exchanger 7, a third line 17 for connecting the valve 9 to an outlet 18 (FIG. 2), a fourth line 19 extending between the primary heat exchanger 6 and the pump 8, and a fifth line 20 for connecting an inlet 21 (FIG. 2) to the secondary heat exchanger 7, pump 8, expansion tank 10, and air venting valve 11.

The lines 12 also include an additional line 22, specifically adapted to deliver a gas, which is also formed on the wall 4 and has fittings 13.

The numeral 23 designates a slot formed through the metal sheet 4*b* of the wall 4; this slot 23 extends between the gas line 22 and its adjoining line 20.

It should be noted that the arrangement shown of the plumbing components for the wall-mounted hot water boiler of this invention is merely an exemplary one; in fact, the aforesaid fittings could be provided at other suitable places on the lines formed on the frame, depending on the design features of the specific plumbing components being used. Such components, moreover, would be advantageously provided with pipe connections at one end thereof intended to confront the hanging frame, whereby they can be engaged directly in the fittings.

The wall-mounted hot water boiler of this invention has shown to be highly compact in size and afforded the primary advantage of the plumbing lines for the plumbing components, being preformed on its hanging frame, in no way interfering with assembling or disassembling the components.

Furthermore, the assembling and disassembling operations are greatly facilitated by the component pipe connections being engageable in the frame plumbing line fittings quickly and without involving the use of tools.

The provision of slots in the frame between adjoining lines has proven especially advantageous, in particular where different fluids, such as heating water, sanitary water, or a gas, are caused to flow therethrough. In fact, in the event of any leakage between the metal sheets at the lines, the slots would be effective to disperse leaking fluids to the outside of the outside of the frame, thus preventing fluids from being transferred between or being admixed within the lines.

A further advantage of this invention is apt to show up particularly with wall-mounted hot water boilers of the so-called "watertight chamber" type, because it is effective to avoid, by the very provision of preformed lines on the frame, tight sealed passages as are normally required for all the plumbing connections between components within and without the watertight chamber.

I claim:

1. A wall mounted hot water heater comprising a substantially flat panel, a fluid inlet, a fluid outlet, water circulating means, a first heat exchanger and a second heat exchanger, all associated with said panel, and a plurality of fluid confining conduits that hydraulically connect said water circulating means and said first and second heat exchangers between said fluid inlet and said fluid outlet, wherein said substantially flat panel constitutes a substantial portion of each of said plurality of fluid confining conduits.

2. A wall mounted hot water heater comprising a substantially flat panel comprising a pair of juxtaposed sheets, a fluid inlet, a fluid outlet, water circulating means, a first heat exchanger and a second heat exchanger, all associated with said panel, a plurality of fluid confining conduits defined by said pair of juxtaposed sheets that hydraulically connect said water circulating means and said first and second heat exchangers between said fluid inlet and said fluid outlet, and a plurality of fittings disposed in fluid connection with said plurality of conduits for connection to respective ones of the first heat exchanger, the second heat exchanger, and the water circulation means, wherein said substantially flat panel constitutes a substantial portion of each of said plurality of fluid confining conduits, and wherein said fittings provide mechanical support for the respective ones of the first heat exchanger, the second heat exchanger, and the water circulating means.

3. A wall mounted hot water heater according to claim 1, wherein said flat panel comprises a pair of juxtaposed sheets the define said plurality of fluid confining conduits.

4. A wall mounted hot water heater according to claim 3 or 2, wherein said sheets define fluid confining conduits of a first type and of a second type for confining associated first and second types of fluids, at least one of said sheets having a slot disposed in a position between said second type of conduit and said first type of conduit.

5. A wall mounted hot water heater according to claim 1, further comprising a plurality of fittings disposed in fluid connection with said plurality of conduits for connection to respective ones of the first heat exchanger, the second heat exchanger, and the water circulation means.

6. A wall mounted hot water heater according to claim 5, wherein said fittings provide mechanical support for the respective ones of the first heat exchanger, the second heat exchanger, and the water circulating means.

* * * * *

UNITED STATES PATENT AND TRADEMARK OFFICE

CERTIFICATE OF CORRECTION

PATENT NO. : 4,917,077

DATED : April 17, 1990

INVENTOR(S) : GIORGIO SCANFERLA

It is certified that error appears in the above-identified patent and that said Letters Patent is hereby corrected as shown below:

COLUMN 4

Line 30, "the defeine" should read --that define--.

Signed and Sealed this

Thirteenth Day of August, 1991

*Attest:*

HARRY F. MANBECK, JR.

*Attesting Officer*

*Commissioner of Patents and Trademarks*